US009536658B2

(12) United States Patent
Omura et al.

(10) Patent No.: US 9,536,658 B2
(45) Date of Patent: Jan. 3, 2017

(54) GRAIN ORIENTED ELECTRICAL STEEL SHEET AND METHOD FOR MANUFACTURING THE SAME

(75) Inventors: Takeshi Omura, Tokyo (JP); Hiroi Yamaguchi, Tokyo (JP); Seiji Okabe, Tokyo (JP)

(73) Assignee: JFE Steel Corporation (JP)

( * ) Notice: Subject to any disclaimer, the term of this patent is extended or adjusted under 35 U.S.C. 154(b) by 730 days.

(21) Appl. No.: 13/814,065

(22) PCT Filed: Aug. 3, 2011

(86) PCT No.: PCT/JP2011/004409

§ 371 (c)(1),
(2), (4) Date: Feb. 4, 2013

(87) PCT Pub. No.: WO2012/017654

PCT Pub. Date: Feb. 9, 2012

(65) Prior Publication Data

US 2013/0143050 A1 Jun. 6, 2013

(30) Foreign Application Priority Data

Aug. 6, 2010 (JP) ..... 2010-178002

(51) Int. Cl.
*H01F 41/00* (2006.01)
*C21D 8/12* (2006.01)
(Continued)

(52) U.S. Cl.
CPC ..... *H01F 41/00* (2013.01); *C21D 8/1272* (2013.01); *C21D 8/1288* (2013.01); *C22C 38/00* (2013.01);
(Continued)

(58) Field of Classification Search
CPC ..... H01F 1/04; H01F 1/18; H01F 41/00; C21D 8/0263; C21D 8/1288; C21D 8/1272; C22C 38/00; C22C 38/04; C22C 38/08
(Continued)

(56) References Cited

U.S. PATENT DOCUMENTS 4,416,707 A * 11/1983 Foster ..... H01F 1/14775 148/111
4,662,954 A * 5/1987 Fedoris ..... 148/112
(Continued)

FOREIGN PATENT DOCUMENTS

CN 101541991 9/2009
EP 0 367 467 5/1990
(Continued)

OTHER PUBLICATIONS

Chinese Official Action dated Jun. 10, 2014 (including an English translation) from corresponding Chinese Patent Application No. 201180038900.X.
(Continued)

*Primary Examiner* — Keith Walker
*Assistant Examiner* — John Hevey
(74) *Attorney, Agent, or Firm* — DLA Piper LLP (US)

(57) ABSTRACT

A grain oriented electrical steel sheet that is subjected to magnetic domain refining treatment by electron beam irradiation and exhibits excellent low-noise properties when assembled as an actual transformer in which tension exerted on the steel sheet by the forsterite film is 2.0 MPa or higher both in a rolling direction and a direction transverse (perpendicular) to the rolling direction, and a ratio of an irradiation pitch in a thermal strain introduced region (B) to a spot diameter (A) on an electron beam irradiation surface satisfies $0.5 \leq B/A \leq 5.0$.

2 Claims, 4 Drawing Sheets

(51) Int. Cl.

| | |
|---|---|
| ***H01F 1/18*** | (2006.01) |
| ***C22C 38/00*** | (2006.01) |
| ***C22C 38/04*** | (2006.01) |
| ***C22C 38/08*** | (2006.01) |
| *B21B 3/02* | (2006.01) |

(52) U.S. Cl.
CPC ..... *C22C 38/008* (2013.01); *C22C 38/04* (2013.01); *C22C 38/08* (2013.01); *H01F 1/18* (2013.01); *B21B 3/02* (2013.01); *C21D 2201/05* (2013.01)

(58) Field of Classification Search
USPC ..... 148/111, 108; 428/450
See application file for complete search history.

(56) References Cited

U.S. PATENT DOCUMENTS

| | | | | |
|---|---|---|---|---|
| 4,909,864 | A | 3/1990 | Inokuti et al. | |
| 5,141,573 | A * | 8/1992 | Nakashima | H01F 1/16 148/111 |
| 5,223,048 | A | 6/1993 | Inokuti | |
| 5,288,736 | A * | 2/1994 | Schoen et al. | 148/113 |
| 5,507,883 | A * | 4/1996 | Tanaka | H01F 1/14783 148/111 |
| 5,853,499 | A * | 12/1998 | Komatsubara | C21D 3/02 148/111 |
| 6,280,862 | B1 * | 8/2001 | Inokuti | 428/698 |
| 6,368,424 | B1 * | 4/2002 | Sakai et al. | 148/113 |
| 6,387,522 | B2 * | 5/2002 | Mogi | C21D 8/1288 148/100 |
| 6,558,479 | B2 * | 5/2003 | Fujikura | H01F 1/14775 148/111 |
| 6,918,966 | B2 * | 7/2005 | Fujikura | H01F 1/14775 148/306 |
| 7,169,479 | B2 * | 1/2007 | Schuhmacher | C21D 8/1288 427/116 |
| 7,371,291 | B2 * | 5/2008 | Hayakawa | C21D 8/1272 148/111 |
| 8,409,370 | B2 * | 4/2013 | Takashima | C21D 8/1283 106/14.12 |
| 8,535,455 | B2 * | 9/2013 | Takashima | C21D 6/00 148/113 |
| 8,771,795 | B2 * | 7/2014 | Muraki | C21D 1/70 427/376.1 |
| 2002/0157734 | A1 * | 10/2002 | Senda et al. | 148/111 |
| 2009/0044881 | A1 * | 2/2009 | Kumano et al. | 148/111 |

FOREIGN PATENT DOCUMENTS

| | | | | |
|---|---|---|---|---|
| EP | 0 571 705 | | 12/1993 | |
| JP | 57-2252 | | 1/1982 | |
| JP | 1-191744 | | 8/1989 | |
| JP | 2-163381 | | 6/1990 | |
| JP | 2-277780 | | 11/1990 | |
| JP | 3-260020 | A | 11/1991 | |
| JP | 3-287725 | A | 12/1991 | |
| JP | 4-214819 | A | 8/1992 | |
| JP | 4-362139 | | 12/1992 | |
| JP | 6-72266 | B | 9/1994 | |
| JP | 2001-303137 | A | 10/2001 | |
| JP | 2001-303261 | * | 10/2001 | C21D 8/12 |
| JP | 3399991 | | 4/2003 | |
| JP | 2003-166018 | A | 6/2003 | |
| JP | 2005-317683 | A | 11/2005 | |
| WO | 2012/001952 | | 1/2012 | |

OTHER PUBLICATIONS

English translation of Japanese Office Action dated Apr. 1, 2014 from corresponding Japanese Patent Application No. 2010-178002.
Mexican Official Action dated Jun. 4, 2015 and its English translation from corresponding Mexican Patent Application No. MX/a/2013/000822.
Extended European Search Report dated Jun. 21, 2016, from corresponding European Application No. 11814291.8.

* cited by examiner

GRAIN ORIENTED ELECTRICAL STEEL SHEET AND METHOD FOR MANUFACTURING THE SAME

RELATED APPLICATIONS

This is a §371 of International Application No. PCT/JP2011/004409, with an international filing date of Aug. 3, 2011 (WO 2012/017654 A1, published Feb. 9, 2012), which is based on Japanese Patent Application No. 2010-178002, filed Aug. 6, 2010, the subject matter of which is incorporated herein by reference.

TECHNICAL FIELD

This disclosure relates to a grain oriented electrical steel sheet suitably used for iron core materials such as transformers and a method for manufacturing the same.

BACKGROUND

Grain oriented electrical steel sheets mainly used as iron cores of transformers are required to have excellent magnetic properties, in particular, less iron loss. To meet this requirement, it is important that secondary recrystallized grains are highly aligned in the steel sheet in the (110)[001] orientation (or so-called Goss orientation) and impurities in the product steel sheet are reduced.

Additionally, there are limitations to control crystal orientation and reduce impurities in terms of balancing with manufacturing cost and so on. Therefore, some techniques have been developed to introduce non-uniformity to the surfaces of a steel sheet in a physical manner and reduce the magnetic domain width for less iron loss, namely, magnetic domain refining techniques.

For example, JP 57-002252 B proposes a technique for reducing iron loss of a steel sheet by irradiating a final product steel sheet with a laser, introducing a high dislocation density region to the surface layer of the steel sheet and reducing the magnetic domain width. JP 06-072266 B proposes a technique for controlling the magnetic domain width by electron beam irradiation.

However, when a grain oriented electrical steel sheet that has been subjected to the above-mentioned magnetic domain refining treatment is assembled into an actual transformer it may produce significant noise. In addition, further improvements are needed to obtain better iron loss properties.

It could therefore be helpful to provide a grain oriented electrical steel sheet that may exhibit excellent low noise and low iron loss properties when assembled as an actual transformer, along with an advantageous method for manufacturing the same.

SUMMARY

To develop a grain oriented electrical steel sheet that may exhibit excellent low noise and low iron loss properties when assembled as an actual transformer, we analyzed the following two factors for their influence on the magnetic domain refining effect: the irradiation pitch of electron beam in a direction intersecting the rolling direction of a steel sheet and the tension of a forsterite film on a surface of the steel sheet.

As a result, we found that for the grain oriented electrical steel sheet that had been subjected to magnetic domain refining treatment by electron beam irradiation, it is possible to improve iron loss by increasing the tension of the forsterite film (a film composed mainly of $Mg_2SiO_4$) and, furthermore, appropriately controlling the relationship between the diameter of each thermal strain-introduced region and the irradiation pitch of the electron beam on an electron beam irradiation surface where the electron beam is irradiated in a spot-like fashion.

We thus provide:

[1] A grain oriented electrical steel sheet comprising a forsterite film formed on a surface thereof, and being subjected to magnetic domain refining treatment by means of electron beam irradiation, wherein tension exerted on the steel sheet by the forsterite film is 2.0 MPa or higher both in a rolling direction and a direction perpendicular to the rolling direction, and wherein a diameter of a thermal strain introduced region (A) and an irradiation pitch (B) on an electron beam irradiation surface satisfy a relation expressed by Formula (1):

$$0.5 \leq B/A \leq 5.0 \quad (1).$$

[2] A method for manufacturing a grain oriented electrical steel sheet, the method comprising:

subjecting a slab for a grain oriented electrical steel sheet to rolling to be finished to a final sheet thickness;

subjecting the sheet to subsequent decarburization;

then applying an annealing separator composed mainly of MgO to a surface of the sheet before subjecting the sheet to final annealing;

subjecting the sheet to subsequent tension coating; and subjecting, after the final annealing or the tension coating, the sheet to magnetic domain refining treatment by means of electron beam irradiation, wherein (i) the annealing separator has a coating amount of 10.0 $g/m^2$ or more, (ii) coiling tension after the application of the annealing separator is controlled within a range of 30 to 150 $N/mm^2$, (iii) an average cooling rate to 700° C. during a cooling step of the final annealing process is controlled to be 50° C./h or lower, (iv) an electron beam diameter is controlled to be 0.5 mm or less, and an electron beam diameter (A') and an irradiation pitch (B) are controlled within a range expressed by Formula (2):

$$1.0 \leq B/A' \leq 7.0 \quad (2), \text{ and}$$

(v) a diameter of a thermal strain introduced region (A) and an irradiation pitch (B) on a beam irradiation surface is controlled within a range expressed by Formula (1):

$$0.5 \leq B/A \leq 5.0 \quad (1)$$

by adjusting irradiation conditions other than the electron beam diameter and irradiation pitch.

[3] The method for manufacturing a grain oriented electrical steel sheet according to item [2] above, wherein the slab for the grain oriented electrical steel sheet is subjected to hot rolling, and optionally, hot rolled sheet annealing, and subsequently subjected to cold rolling once, or twice or more with intermediate annealing performed therebetween, to be finished to a final sheet thickness.

It is possible to provide a grain oriented electrical steel sheet that allows an actual transformer assembled therefrom to effectively maintain the effect of reducing iron loss by magnetic domain refining using an electron beam. Therefore, the actual transformer may exhibit excellent low iron loss properties.

BRIEF DESCRIPTION OF THE DRAWINGS

Our steel sheets and methods will be further described below with reference to the accompanying drawings, wherein.

DETAILED DESCRIPTION

In a grain oriented electrical steel sheet that has been subjected to magnetic domain refining treatment by electron beam irradiation, it is, important to increase the tension of a forsterite film and to appropriately control the relationship between an electron beam diameter and a diameter of a thermal strain introduced region on a surface of the steel sheet where an electron beam is irradiated in a spot-like fashion, and an irradiation pitch of the electron beam.

Figure 1:
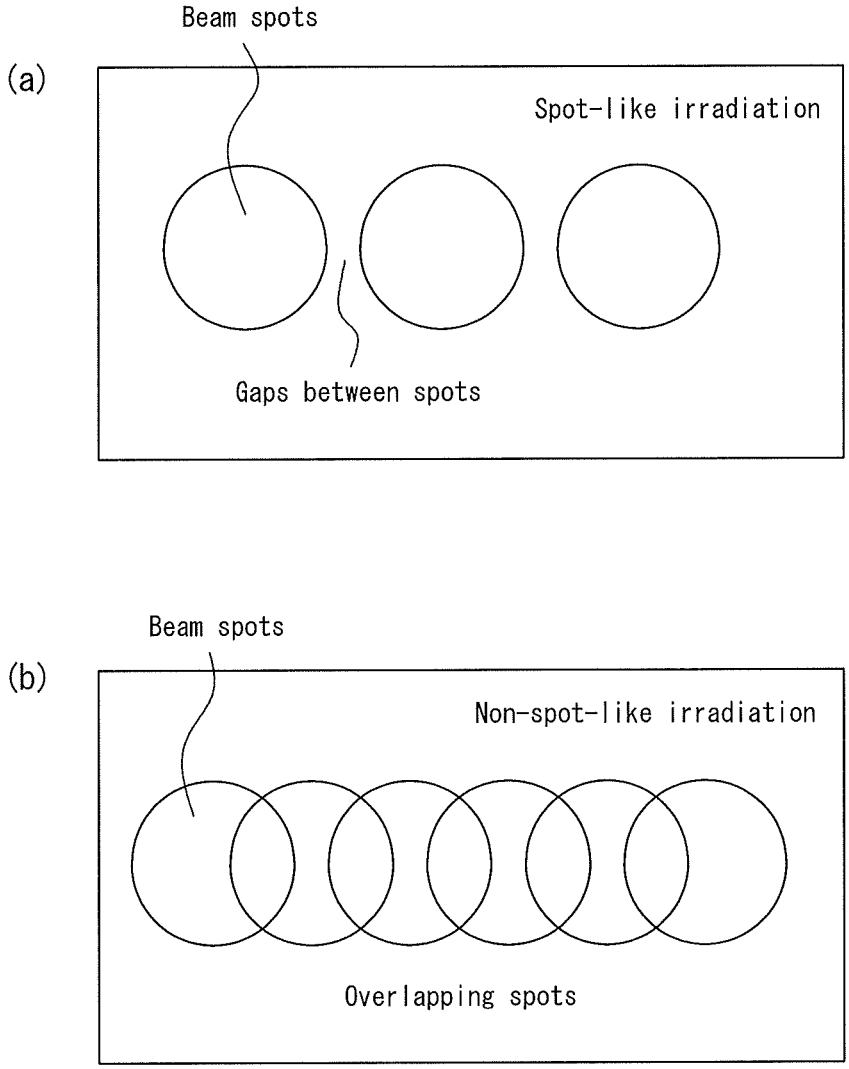
FIG. 1 illustrates (a) spot-like irradiation and (b) non-spot-like irradiation in electron beam irradiation.

The term "electron beam diameter" (hereinafter, also referred to simply as "beam diameter") means an irradiation diameter of electron beam. Further, "spot-like irradiation" of an electron beam indicates that two neighboring regions (labeled "beam spots" in the figure), each of the same size as the beam diameter, do not overlap with each other (see (a) and (b) of FIG. 1).

Figure 2:
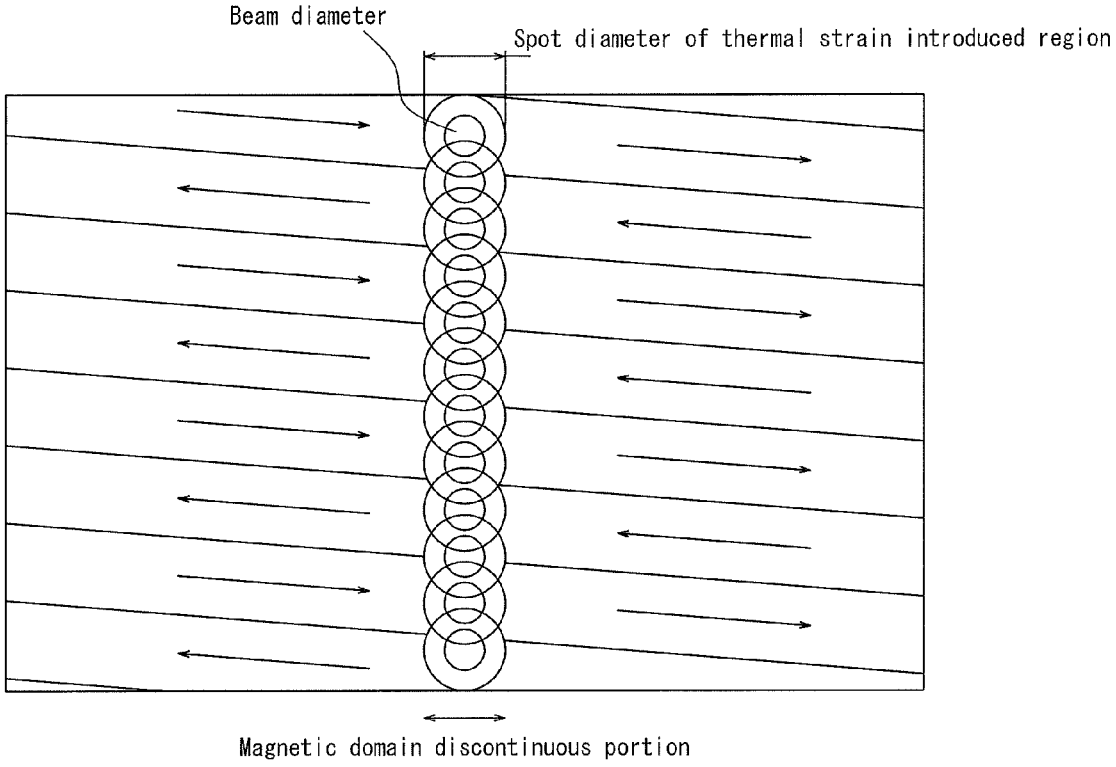
FIG. 2 schematically illustrates the concept of spot diameter of a thermal strain-introduced region.

Yet further, "diameter of a thermal strain introduced region" (hereinafter, also referred to as "spot diameter") directly means a diameter of a thermal strain introduced region that is obtained by electron beam irradiation as shown in FIG. 2. However, this diameter may also be calculated from the width of a magnetic domain discontinuous portion produced by introduction of thermal strain.

When the surface of the steel sheet is irradiated with an electron beam, an area corresponding to the beam diameter of the electron beam is heated. However, since the heat applied to the steel sheet is diffused, each thermal strain introduced region generally has a spot diameter larger than the beam diameter.

Hereinbelow, reference will be made to the experiments. Samples having forsterite films with different tensions were irradiated with an electron beam. In this case, a determination was made as to how tension influences iron loss. Irradiation conditions are as follows: acceleration voltage=40 kV; beam current=1.5 mA; beam scanning rate=5 m/s; beam diameter=0.2 mm; irradiation pitch in a direction intersecting the rolling direction=0.05, 0.10, 0.15, 0.25, 0.5, 1.0, 1.4, 3.0, 5.0 and 10.0 mm; and irradiation interval in the rolling direction=7.5 mm.

Figure 3:
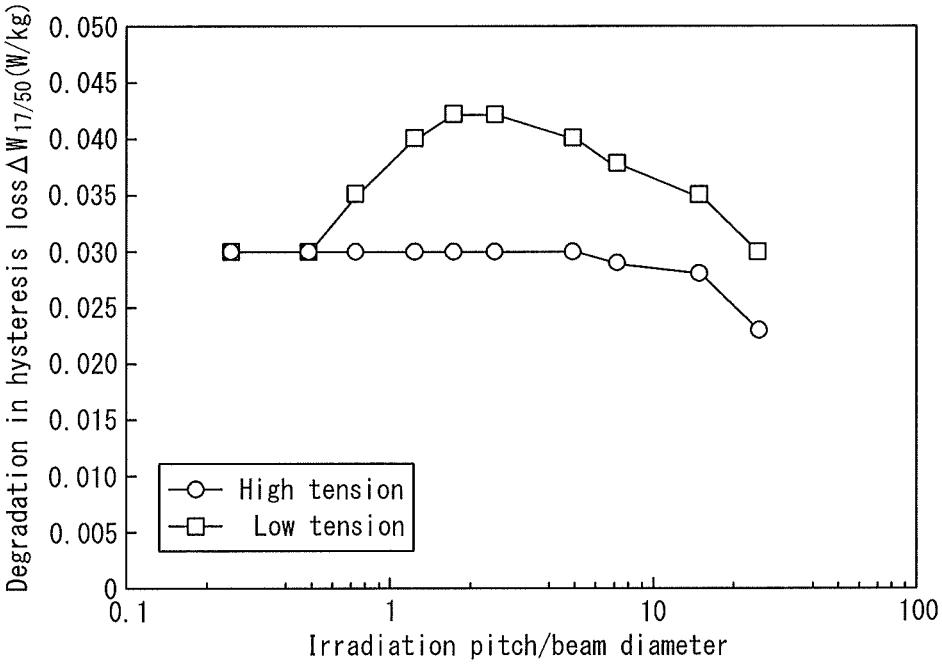
FIG. 3 is a graph showing the relationship between the irradiation pitch/beam diameter and the degradation in hysteresis loss.

FIG. 3 shows degradation in hysteresis loss caused by the thermal strain being introduced to the steel sheet due to electron beam irradiation. As can be seen, for each sample having a strong film tension (good film tension), degradation in iron loss does not change until the irradiation pitch of an electron beam in a direction intersecting the rolling direction reaches a certain value. On the other hand, for each sample having a weak film tension, degradation in iron loss increases with the increase of the irradiation pitch in a direction intersecting the rolling direction. In this case, irradiation pitch represents a distance between the centers of beam spots.

Figure 4:
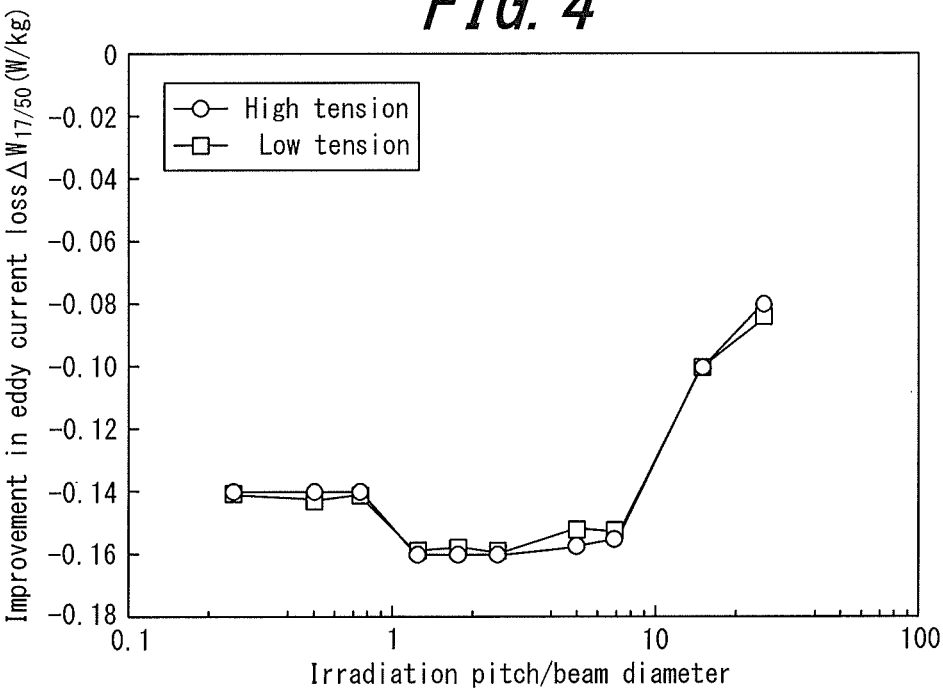
FIG. 4 is a graph showing the relationship between the irradiation pitch/beam diameter and improvement in eddy current loss.

Then, FIG. 4 shows the improvement in eddy current loss caused by the thermal strain introduced to the steel sheet due to electron beam irradiation. As shown in the figure, irrespective of the difference in tension among forsterite films, a tendency was observed that the improvement in eddy current loss is enhanced until a certain irradiation pitch is reached, and reduced from that point.

Figure 5:
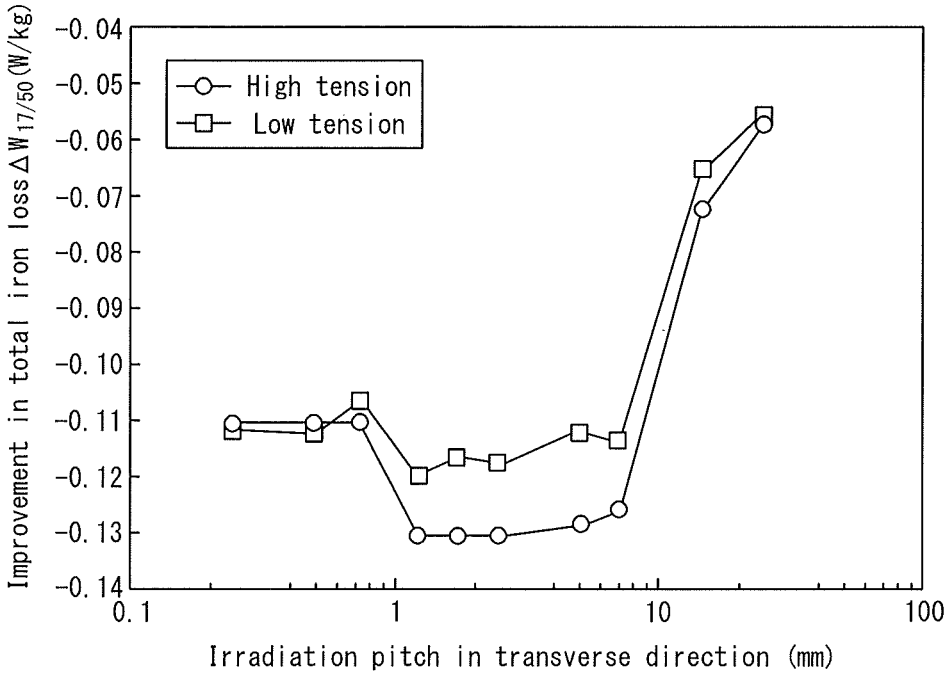
FIG. 5 is a graph showing the relationship between the irradiation pitch/beam diameter and improvement in total iron loss.

Further, the improvement in total iron loss is shown in FIG. 5. It can be seen from the figure that a significant increase in the improvement in iron loss is observed within a range where the forsterite film has a strong tension and spot-like irradiation is performed with a larger irradiation pitch in a direction intersecting the rolling direction.

Figure 6:
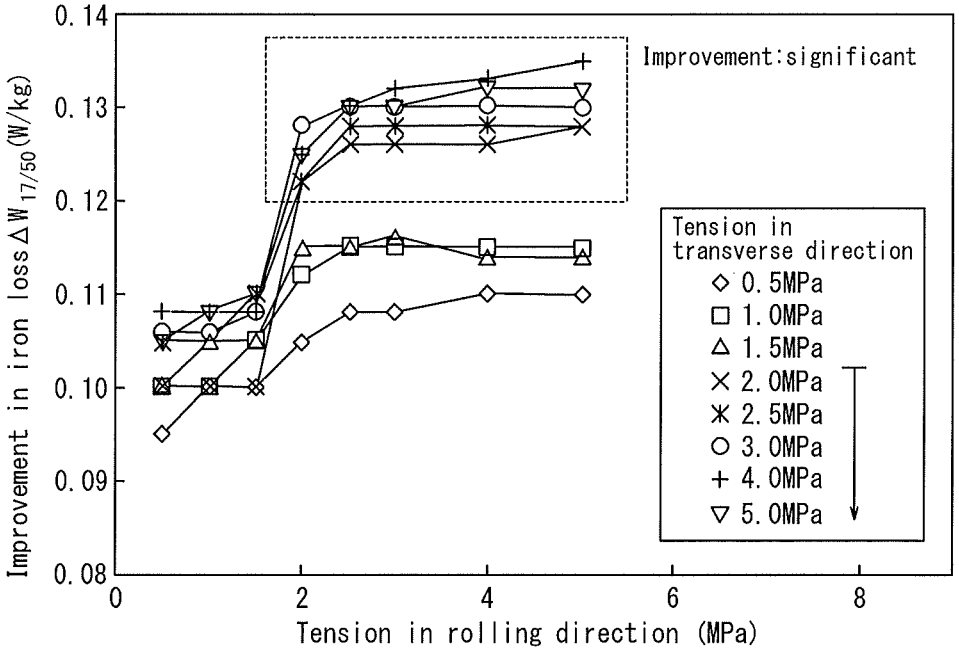
FIG. 6 is a graph showing the relationship between the tension in the rolling direction and the improvement in iron loss.

Then, the relationship between the tension of each forsterite film and the improvement in iron loss was analyzed, the results of which are shown in FIG. 6. In this case, an electron beam was irradiated under the following conditions: acceleration voltage=40 kV; beam current=1.5 mA; beam scanning rate=5 m/s; beam diameter=0.2 mm; irradiation pitch in a direction intersecting the rolling direction=0.25 mm; and irradiation interval in the rolling direction=7.5 mm.

As shown in FIG. 6, we found that the iron loss can be improved significantly when the forsterite film has a tension of 2.0 MPa or higher both in the rolling direction and a direction transverse (perpendicular) to the rolling direction (hereinafter, referred to as "transverse direction"). There is no particular upper limit to the tension of a forsterite film as long as the steel sheet cannot deform plastically. The tension of a forsterite film is preferably 200 MPa or lower.

Thereafter, the tension of a forsterite film and the electron beam irradiation conditions were kept within a preferred range, and then other irradiation conditions including acceleration voltage of electron beam, beam current and beam scanning rate were varied to change the amount of thermal strain introduced to the steel sheet. As a result, we found that for a greater improvement in iron loss, a ratio of an irradiation pitch (B) to a spot diameter of a thermal strain introduced region (A) on a beam irradiation surface needs to satisfy a relation expressed by Formula (1):

$$0.5 \leq B/A \leq 5.0 \quad (1).$$

Thus, to have a greater effect in improving iron loss at the time of magnetic domain refining treatment by electron beam irradiation, the tension of the forsterite film was increased and the electron beam diameter and irradiation pitch were controlled appropriately and, furthermore, a ratio of an irradiation pitch (B) to a spot diameter of a thermal strain introduced region (A) on a beam irradiation surface was controlled within the range represented by Formula (1) above by adjusting irradiation conditions other than the electron beam diameter and irradiation pitch.

Reference will now be made to a method for measuring film tension. When measuring the tension in the rolling direction, a sample of 280 mm in the rolling direction×30 mm in the transverse direction is cut from the product (tension coating-applied material), whereas when measuring the tension in the transverse direction, a sample of 280 mm in the transverse direction×30 mm in the rolling direction is cut from the product. In either case, the tension coating on each side of the sample is stripped off with an alkaline solution. Then, the forsterite film on one side is removed with a hydrochloric acid solution. Then, the steel sheet warpage is determined by measuring the warpage before and after the removal and converted to tension using the Conversion Formula (3) given below. The tension determined by this method represents the tension being exerted on the surface from which the forsterite film has not been removed.

Since tension is exerted on both sides of the sample, tension exerted on one side of the steel sheet is determined by the above-described method and, furthermore, tension on the other side is determined by the same method, except that another sample taken from another position of the same product is used, to derive an average value of tension. This average value is considered as the tension being exerted on the sample.

$$\sigma = \frac{Ed}{l^2}(a_2 - a_1) \qquad \text{Conversion Formula (3)}$$

where: σ: film tension (MPa)

E: Young's modulus of steel sheet=143 (GPa)

l: warpage measurement length (mm)

$a_1$: warpage before removal (mm)

$a_2$: warpage after removal (mm)

d: steel sheet thickness (mm).

While the mechanism for this significant improvement in iron loss under the above-identified conditions has not been clarified, we believe as follows:

<Mechanism for Enhancement of Improvement in Eddy Current Loss by Spot-Like Irradiation>

Assuming the same amount of heat applied to the steel sheet, when the irradiation pitch of an electron beam is narrow, a constant amount of heat is applied to the region on the irradiated radiation, in which case a uniform compressive stress distribution is obtained, whereas when the irradiation pitch is made wider and a larger amount of heat is applied to a local site, a larger compressive stress is applied locally, in which case a non-uniform stress distribution is provided. We believe that this difference in the compressive stress distribution caused a difference in the distribution of tensile stress exerted on those parts other than the irradiated parts and, therefore, the improvement in eddy current loss was enhanced.

We also believe that the improvement in eddy current loss was reduced at or above a certain level of irradiation pitch because of an increase in the number of regions with low compressive stress due to the changes in the compressive stress distribution as described above.

Further, we believe that it is necessary to control a ratio of an irradiation pitch (B) to a spot diameter of a thermal strain introduced region (A) on a beam irradiation surface, as mentioned above, by adjusting irradiation conditions other than the irradiation pitch and beam diameter to maintain the above-described stress non-uniformity. This is because the stress non-uniformity established by controlling the irradiation pitch and beam diameter will be lost easily if inappropriate irradiation conditions other than the irradiation pitch and beam diameter are used.

<Mechanism for Inhibition of Hysteresis Loss Degradation by Increasing the Tension of the Forsterite Film>

We believe that the stress exerted by the forsterite film on the steel sheet suppresses the stress caused by thermal strain, thereby inhibiting degradation in hysteresis loss of the steel sheet.

That is, while the magnetostrictive vibration waveform is distorted near an irradiation part to which thermal strain is introduced and noise increases with a superimposed harmonic component, it is considered that increasing the tension of the forsterite film is extremely effective in suppressing distortion in the magnetostrictive vibration waveform.

Reference will now be made to the points of a method for manufacturing a steel sheet. One of the key points relating to the manufacturing method is to increase the tension of a forsterite film exerted on a steel sheet. Important measures to be taken in increasing the tension of the forsterite film include:

(I) applying an annealing separator in an amount of 10.0 g/m$^2$ or more;

(II) controlling coiling tension after the application of the annealing separator within a range of 30 to 150 N/mm$^2$; and (III) controlling an average cooling rate to 700° C. during a cooling step of the final annealing to be 50° C./h or lower.

Since the steel sheet is subjected to the final annealing in the coiled form, it is prone to temperature variations during cooling and the amount of thermal expansion in the steel sheet likely varies with location. Accordingly, stress is exerted on the steel sheet in various directions. Further, when the steel sheet is coiled tightly, large stress is exerted on the steel sheet since there is no gap between surfaces of adjacent turns of the steel sheet and this large stress would damage the forsterite film. Accordingly, what is effective in avoiding damage to the forsterite film is to reduce the stress generated in the steel sheet by leaving some gaps between surfaces of adjacent turns of the steel sheet, and to decrease the cooling rate and thereby reduce temperature variations in the coil.

Hereinbelow, reference will be made to the mechanism to increase tension of the forsterite film by controlling the above-listed items (I) to (III). Since an annealing separator releases moisture or $CO_2$ during annealing, a region to which the annealing separator is applied shows a decrease in volume over time after application. That is, a decrease in volume indicates the occurrence of gaps in the applied region and, therefore, the amount of the annealing separator applied affects the stress relaxation in the coil. Accordingly, if the annealing separator has a small coating amount, this will result in insufficient gaps. Therefore, the amount of the annealing separator applied is 10.0 g/m$^2$ or more. In addition, there is no particular upper limit to the amount of the annealing separator applied, without interfering with the manufacturing process (such as causing weaving of the coil during the final annealing). If any inconvenience such as weaving is caused, it is preferable that the annealing separator is applied in an amount of 50 g/m$^2$ or less.

In addition, as coiling tension is reduced, more gaps are created between surfaces of adjacent turns of the steel sheet than in the case where the steel sheet is coiled with a higher tension. This results in less stress generated in the coil. However, an excessively low coiling tension also has a problem in that it would cause uncoiling of the coil. Accordingly, it is necessary to provide such a coiling tension condition under which any stress caused by temperature variations during cooling can be relaxed and uncoiling will not occur, within a range of 30 to 150 N/mm$^2$.

Further, if the cooling rate during the final annealing is lowered, temperature variations are reduced in the steel sheet and, therefore, the stress in the coil is relaxed. A slower cooling rate is better from the viewpoint of stress relaxation, but less favorable in terms of production efficiency. It is thus preferable that the cooling rate is 5° C./h or higher. A cooling rate of 5° C./h or higher cannot be achieved by controlling the cooling rate alone to relax the stress in the coil. However, by virtue of a combination of controlling of the amount of the annealing separator applied by controlling coiling tension, an up to 50° C./h cooling rate is acceptable. In this way, the forsterite film may be provided with increased tension in the rolling direction and transverse direction by controlling the amount of the annealing separator applied, coiling tension and cooling rate and by relaxing the stress in the coil.

The second key point is to set an electron beam diameter of 0.5 mm or less and irradiate an electron beam in a spot-like fashion. In this case, if an electron beam diameter is too large, the depth to which the electron beam penetrates in the sheet thickness direction is reduced, in which case an optimum stress distribution cannot be obtained. Therefore, it is necessary to increase the amount of energy penetrating in the sheet thickness direction by setting an electron beam diameter to 0.5 mm or less and irradiating as small a region as possible with electrons. More preferably, the electron beam diameter is 0.3 mm or less. It is also necessary to control the ratio of an irradiation pitch in a direction intersecting the rolling direction (B) to an electron beam diameter (A') within a range expressed by Formula (2):

$$1.0 \leq B/A' \leq 7.0 \quad (2).$$

This is because if the ratio (B/A') is less than 1.0, irradiation pitch is too narrow to provide a non-uniform stress distribution. On the other hand, if the ratio (B/A') is more than 7.0, stress-occurring points become too distant and low stress regions are generated, which results in an insufficient magnetic domain refining effect and reduces the effect of improving iron loss.

After satisfying the above-mentioned irradiation conditions, it is still necessary to adjust other irradiation conditions including acceleration voltage, beam current and beam scanning rate, and to control the amount of heat to be introduced to the steel sheet so that a ratio of an irradiation pitch (B) to a spot diameter of a thermal strain introduced region (A) on a beam irradiation surface is controlled within a range expressed by Formula (1):

$$0.5 \leq B/A \leq 5.0 \quad (1).$$

This is because an optimum stress distribution cannot be obtained if a beam current value and a scanning rate that fail to satisfy this relation are set.

Based on the aforementioned results, a determination was made as to whether a similar effect can also be obtained by magnetic domain refining treatment using laser irradiation. In the case of laser irradiation, however, the effect achieved by electron beam irradiation was not achieved. This is because laser and electron beam differ in the way heat is transferred in the steel sheet. It is estimated that an electron beam and a laser have different stress distributions generated in the steel sheet because it is easier for an electron beam to penetrate in the sheet thickness direction than for a laser. It is thus believed that during the process of magnetic domain refining by laser irradiation, stress distribution generated in the steel sheet failed to provide any region where the iron loss is reduced.

Next, the conditions of manufacturing a grain oriented electrical steel sheet will be specifically described below.

A slab for a grain oriented electrical steel sheet may have any chemical composition that allows for secondary recrystallization. In addition, the higher the degree of the crystal grain alignment in the <100> direction, the greater the effect of reducing the iron loss obtained by magnetic domain refining. It is thus preferable that a magnetic flux density $B_8$, which gives an indication of the degree of the crystal grain alignment, is 1.90 T or higher.

In addition, if an inhibitor, e.g., an AlN-based inhibitor is used, Al and N may be contained in an appropriate amount, respectively, while if a MnS/MnSe-based inhibitor is used, Mn and Se and/or S may be contained in an appropriate amount, respectively. Of course, these inhibitors may also be used in combination. In this case, preferred contents of Al, N, S and Se are: Al: 0.01 to 0.065 mass %; 0.005 to 0.012 mass %; S: 0.005 to 0.03 mass %; and Se: 0.005 to 0.03 mass %, respectively.

Further, our grain oriented electrical steel sheet may have limited contents of Al, N, S and Se without using an inhibitor. In this case, the amounts of Al, N, S and Se are preferably Al: 100 mass ppm or less: N: 50 mass ppm or less; S: 50 mass ppm or less; and Se: 50 mass ppm or less, respectively.

The basic elements and other optionally added elements of the slab for a grain oriented electrical steel sheet will be specifically described below.

<C: 0.08 Mass % or Less>

C is added to improve the texture of a hot-rolled sheet. However, C content exceeding 0.08 mass % increases the burden to reduce C content to 50 mass ppm or less where magnetic aging will not occur during the manufacturing process. Thus, C content is preferably 0.08 mass % or less. Besides, it is not necessary to set up a particular lower limit to C content because secondary recrystallization is enabled by a material without containing C.

<Si: 2.0 to 8.0 Mass %>

Si is an element useful to increase electrical resistance of steel and improve iron loss. Si content of 2.0 mass % or more has a particularly good effect in reducing iron loss. On the other hand, Si content of 8.0 mass % or less may offer particularly good formability and magnetic flux density. Thus, Si content is preferably 2.0 to 8.0 mass %.

<Mn: 0.005 to 1.0 Mass %>

Mn is an element advantageous to improve hot formability. However, Mn content less than 0.005 mass % has a less addition effect. On the other hand, Mn content of 1.0 mass % or less provides a particularly good magnetic flux density to the product sheet. Thus, Mn content is preferably 0.005 to 1.0 mass %.

Further, in addition to the above elements, the slab may also contain the following elements as elements to improve magnetic properties:

at least one element selected from: Ni: 0.03 to 1.50 mass; Sn: 0.01 to 1.50 mass %; Sb: 0.005 to 1.50 mass; Cu: 0.03 to 3.0 mass %; P: 0.03 to 0.50 mass %; Mo: 0.005 to 0.10 mass %; and Cr: 0.03 to 1.50 mass %.

Ni is an element useful to further improve the texture of a hot-rolled sheet to obtain even more improved magnetic properties. However, Ni content of less than 0.03 mass % is less effective in improving magnetic properties, whereas Ni content of 1.5 mass % or less increases, in particular, the stability of secondary recrystallization and provides even more improved magnetic properties. Thus, Ni content is preferably 0.03 to 1.5 mass %.

Sn, Sb, Cu, P, Mo and Cr are elements useful to further improve the magnetic properties, respectively. However, if any of these elements is contained in an amount less than its lower limit described above, it is less effective in improving the magnetic properties, whereas if contained in an amount equal to or less than its upper limit as described above, it gives the best growth of secondary recrystallized grains. Thus, each of these elements is preferably contained in an amount within the above-described range. The balance other than the above-described elements is Fe and incidental impurities that are incorporated during the manufacturing process.

Then, the slab having the above-described chemical composition is subjected to heating before hot rolling in a conventional manner. However, the slab may also be subjected to hot rolling directly after casting without being subjected to heating. In the case of a thin slab, it may be subjected to hot rolling or proceed to the subsequent step, omitting hot rolling.

Further, the hot rolled sheet is optionally subjected to hot rolled sheet annealing. A main purpose of the hot rolled sheet annealing is to improve the magnetic properties by dissolving the band texture generated by hot rolling to obtain a primary recrystallization texture of uniformly-sized grains and thereby further developing a Goss texture during secondary recrystallization annealing. As this moment, to obtain a highly-developed Goss texture in a product sheet, a hot rolled sheet annealing temperature is preferably 800° C. to 1100° C. If a hot rolled sheet annealing temperature is lower than 800° C., there remains a band texture resulting from hot rolling, which makes it difficult to obtain a primary recrystallization texture of uniformly-sized grains and impedes a desired improvement of secondary recrystallization. On the other hand, if a hot rolled sheet annealing temperature exceeds 1100° C., the grain size after the hot rolled sheet annealing coarsens too much, which makes it difficult to obtain a primary recrystallization texture of uniformly-sized grains.

After the hot rolled sheet annealing, the sheet is subjected to cold rolling once, or twice or more with intermediate annealing performed therebetween, followed by decarburization (combined with recrystallization annealing) and application of an annealing separator to the sheet. After application of the annealing separator, the sheet is subjected to final annealing for purposes of secondary recrystallization and formation of a forsterite film. It should be noted that the annealing separator is preferably composed mainly of MgO to form forsterite. As used herein, the phrase "composed mainly of MgO" implies that any well-known compound for the annealing separator and any property improvement compound other than MgO may also be contained within a range without interfering with the formation of a forsterite film intended by the invention.

After the final annealing, it is effective to subject the sheet to flattening annealing to correct the shape thereof. An insulation coating is applied to the surfaces of the steel sheet before or after the flattening annealing. As used herein, this insulation coating means such coating that may apply tension to the steel sheet to reduce iron loss (hereinafter, referred to as tension coating). Tension coating includes inorganic coating containing silica and ceramic coating by physical vapor deposition, chemical vapor deposition, and so on.

The grain oriented electrical steel sheet after the final annealing or tension coating as mentioned above is subjected to magnetic domain refining by irradiating the surfaces of the steel sheet with electron beam. When an electron beam is irradiated, a current value is preferably set at 0.1 to 100 mA at an acceleration voltage of 10 to 200 kV. It is also preferable to irradiate an electron beam at about 1 to 20 mm intervals in the rolling direction. It is also preferable that the depth of plastic strain applied to the steel sheet is about 10 to 40 μm. While an electron beam should be irradiated in a direction intersecting the rolling direction, this irradiation direction is preferably at about 45° to 90° to the rolling direction.

Except the above-mentioned steps and manufacturing conditions, it is possible to apply a conventionally well-known method for manufacturing a grain oriented electrical steel sheet where magnetic domain refining treatment is performed by an electron beam.

EXAMPLES

Experiment 1

Steel slabs, each having a chemical composition as shown in Table 1, were manufactured by continuous casting. Each of these steel slabs was heated to 1430° C., subjected to hot rolling to be finished to a hot-rolled sheet having a sheet thickness of 1.6 mm, and then subjected to hot rolled sheet annealing at 1000° C. for 10 seconds. Subsequently, each steel sheet was subjected to cold rolling to an intermediate sheet thickness of 0.55 mm, and then to intermediate annealing under the following conditions: degree of oxidation $PH_2O/PH_2$=0.37, temperature=1100° C., and duration=100 seconds. Subsequently, each steel sheet was subjected to hydrochloric acid pickling to remove subscales from the surfaces thereof, followed by cold rolling again to be finished to a cold-rolled sheet having a sheet thickness of 0.23 mm.

Then, each steel sheet was subjected to decarburization where it was retained at a degree of oxidation $PH_2O/PH_2$ of 0.45 and a soaking temperature of 850° C. for 150 seconds. Then, an annealing separator composed mainly of MgO was applied to each steel sheet. At this moment, the amount of the annealing separator applied and the coiling tension after the application of the annealing separator were varied as shown in Table 2. Thereafter, each steel sheet was subjected to final annealing for the purposes of secondary recrystallization and purification under the conditions of 1180° C. and 60 hours. In this final annealing, the average cooling rate during the cooling step at a temperature range of 700° C. or higher was varied. Then, tension coating composed of 50% of colloidal silica and magnesium phosphate was applied to each steel sheet.

Thereafter, each steel sheet was subjected to magnetic domain refining treatment where it was irradiated with an electron beam in a spot-like fashion to be finished to a product under the irradiation conditions of: acceleration voltage=50 kV, beam current=2.0 mA, beam scanning rate=15 m/second, beam diameter=0.18 mm, irradiation interval in a rolling direction=6.0 mm, irradiation pitch in a direction intersecting the rolling direction=0.5 mm, and intersecting angle to the rolling direction=80°. Each product was measured for its iron loss and film tension. Then, each product was subjected to oblique shearing to be assembled into a three-phase transformer at 750 kVA, and then measured for its iron loss and noise in a state where it was excited at 50 Hz and 1.7 T. This transformer has a designed value of noise of 62 dB.

The above-mentioned measurement results on iron loss and noise are shown in Table 2.

TABLE 1

| Chemical Composition (mass %, C, O, N, Al, Se, S in mass ppm) | | | | | | | | |
|---|---|---|---|---|---|---|---|---|
| C | S | Mn | Ni | O | N | Al | Se | S |
| 500 | 2.85 | 0.1 | 0.01 | 25 | 70 | 260 | 110 | 30 |

TABLE 2

| ID | Amount of annealing separator applied [g/m$^2$] | Coiling Tension After Applying Annealing Separator [N/mm$^2$] | Cooling Rate to 700° C. [° C./h] | Tension Applied to Steel Sheet: Tension in Rolling Direction [MPa] | Tension Applied to Steel Sheet: Tension in Transverse Direction [MPa] | Irradiation Pitch/ Spot Diameter of Thermal Strain Introduced Region (B/A) | Product $W_{17/50}$ [W/kg] | Transformer Noise [dBA] | Others | Remarks |
|---|---|---|---|---|---|---|---|---|---|---|
| 1 | 14 | 20 | 20 | — | — | 1.6 | — | — | uncoiling occurred, not available as a product | Comparative Example |
| 2 | 4 | 40 | 35 | 1.8 | 1.2 | 1.6 | 0.69 | 68 | — | Comparative Example |
| 3 | 7 | 40 | 35 | 2.4 | 1.5 | 1.6 | 0.69 | 68 | — | Comparative Example |
| 4 | 11 | 40 | 10 | 3.3 | 3.3 | 1.6 | 0.66 | 61 | — | Example of Present Invention |
| 5 | 16 | 40 | 30 | 4.0 | 4.2 | 1.6 | 0.66 | 61 | — | Example of Present Invention |
| 6 | 13 | 70 | 40 | 4.2 | 3.5 | 1.6 | 0.66 | 61 | | Example of Present Invention |
| 7 | 13 | 70 | 110 | 1.5 | 1.8 | 1.6 | 0.69 | 69 | — | Comparative Example |
| 8 | 8 | 70 | 25 | 1.3 | 2.1 | 1.6 | 0.69 | 69 | — | Comparative Example |
| 9 | 13 | 70 | 2 | 4.2 | 3.8 | 1.6 | 0.66 | 61 | — | Example of Present Invention |
| 10 | 16 | 170 | 25 | 1.6 | 2.2 | 1.6 | 0.69 | 69 | — | Comparative Example |
| 11 | 7 | 170 | 25 | 1.0 | 1.2 | 1.6 | 0.69 | 70 | — | Comparative Example |
| 12 | 14 | 170 | 80 | 0.8 | 1.0 | 1.6 | 0.69 | 70 | — | Comparative Example |

As shown in Table 2, each grain oriented electrical steel sheet that was subjected to magnetic domain refining treatment by an electron beam and falls within our range produces low noise when assembled as an actual transformer and exhibits properties consistent with the designed value. In addition, degradation in iron loss properties is also inhibited. In contrast, steel sample IDs 2, 3, 8 and 11 are outside our range in terms of the amount of the annealing separator applied, steel sample IDs 10, 11 and 12 each have a coiling tension outside our range, and steel sample IDs 7 and 12 each have a cooling rate outside our range. None of these examples satisfies the requirements on the tension to be exerted on the steel sheet and the designed value of noise as specified.

Experiment 2

Steel slabs, each having the chemical composition as shown in Table 1, were manufactured by continuous casting. Each of these steel slabs was heated to 1430° C., subjected to hot rolling to be finished to a hot-rolled sheet having a sheet thickness of 1.6 mm, and then subjected to hot rolled sheet annealing at 1000° C. for 10 seconds. Subsequently, each steel sheet was subjected to cold rolling to an intermediate sheet thickness of 0.55 mm, and then to intermediate annealing under the following conditions: degree of oxidation $PH_2O/PH_2$=0.37, temperature=1100° C., and duration=100 seconds. Subsequently, each steel sheet was subjected to hydrochloric acid pickling to remove subscales from the surfaces thereof, followed by cold rolling again to be finished to a cold-rolled sheet having a sheet thickness of 0.23 mm.

Then, each steel sheet was subjected to decarburization where it was retained at a degree of oxidation $PH_2O/PH_2$=0.45 and a soaking temperature of 850° C. for 150 seconds. Then, an annealing separator composed mainly of MgO was applied to each steel sheet. At this moment, the amount of the annealing separator applied was 12 g/m$^2$ and the coiling tension was 60 N/mm$^2$. Thereafter, each steel sheet was subjected to final annealing for the purposes of secondary recrystallization and purification under the conditions of 1180° C. and 60 hours. During this cooling step of the secondary recrystallization annealing (final annealing), the average cooling rate to 700° C. was 15° C./h. Then, tension coating composed of 50% of colloidal silica and magnesium phosphate was applied to each steel sheet.

Thereafter, each steel sheet was subjected to magnetic domain refining treatment by either an electron beam or a laser to be finished to a product for which the iron loss and film tension were measured. In both cases of an electron beam and a laser, the beam diameter, irradiation pitch in a direction intersecting the rolling direction, beam current value and scanning rate were varied as shown in Table 3. Other conditions are as follows.

a) Electron Beam:
- acceleration voltage: 150 kV
- irradiation interval in the rolling direction: 5 mm
- intersecting angle to the rolling direction: 90° b) Laser:
- wavelength: 0.53 μm pulsed laser
- beam scanning rate: 300 mm/sec
- laser output: 15 W
- irradiation interval in the rolling direction=5 mm Then, each product was subjected to oblique shearing to be assembled into a three-phase transformer at 500 kVA, and then measured for its iron loss and noise in a state where it was excited at 50 Hz and 1.7 T. This transformer has a designed value of noise of 55 dB.

The above-mentioned measurement results on iron loss and noise are shown in Table 3.

TABLE 3

| ID | Beam Type | Beam Diameter (A') [mm] | Irradiation Pitch in Direction Intersecting Rolling Direction (B) [mm] | B/A' | Beam Current Value [mA] | Scanning Rate [m/sec] | Irradiation Pitch/Spot Diameter of Thermal Strain Introduced Region (B/A) | Tension Applied to Steel Sheet: Tension in Rolling Direction [MPa] | Tension Applied to Steel Sheet: Tension in Transverse Direction [MPa] | Product $W_{17/50}$ [W/kg] | Transformer Noise [dBA] | Remarks |
|---|---|---|---|---|---|---|---|---|---|---|---|---|
| 1 | Electron Beam | 0.07 | 0.45 | 6.4 | 1.5 | 20 | 2.3 | 3.5 | 4.2 | 0.66 | 54 | Example of Present Invention |
| 2 | Electron Beam | 0.07 | 0.45 | 6.4 | 0.5 | 20 | 5.6 | 3.6 | 4.2 | 0.71 | 54 | Comparative Example |
| 3 | Electron Beam | 0.1 | 0.15 | 1.5 | 1.5 | 20 | 1.6 | 3.5 | 4.2 | 0.66 | 54 | Example of Present Invention |
| 4 | Electron Beam | 0.1 | 0.15 | 1.5 | 5.0 | 5 | 0.3 | 3.5 | 4.2 | 0.71 | 54 | Comparative Example |
| 5 | Electron Beam | 0.2 | 0.05 | 0.25 | 2.0 | 25 | 1.3 | 3.6 | 4.3 | 0.71 | 54 | Comparative Example |
| 6 | Laser | 0.2 | 0.05 | 0.25 | — | — | 1.3 | 3.5 | 4.2 | 0.71 | 54 | Comparative Example |
| 7 | Electron Beam | 0.05 | 0.26 | 5.2 | 2.2 | 20 | 3.5 | 3.5 | 4.1 | 0.68 | 54 | Example of Present Invention |
| 8 | Laser | 0.05 | 0.26 | 5.2 | — | — | 3.5 | 3.2 | 4.2 | 0.72 | 54 | Comparative Example |
| 9 | Electron Beam | 0.2 | 1.50 | 7.5 | 2.0 | 10 | 6 | 3.6 | 4.0 | 0.74 | 54 | Comparative Example |
| 10 | Laser | 0.2 | 1.50 | 7.5 | — | — | 6 | 3.5 | 4.2 | 0.74 | 54 | Comparative Example |
| 11 | Electron Beam | 0.25 | 0.35 | 1.4 | 1.5 | 20 | 1.75 | 3.8 | 3.8 | 0.68 | 54 | Example of Present Invention |
| 12 | Electron Beam | 0.55 | 0.25 | 0.45 | 3.5 | 10 | 0.4 | 3.9 | 3.7 | 0.72 | 54 | Comparative Example |
| 13 | Electron Beam | 0.55 | 1.2 | 2.2 | 1.5 | 15 | 2.0 | 3.5 | 4.1 | 0.72 | 54 | Comparative Example |
| 14 | Electron Beam | 0.55 | 4.0 | 7.3 | 2.5 | 10 | 6.6 | 3.5 | 4.2 | 0.72 | 54 | Comparative Example |

As shown in Table 3, each grain oriented electrical steel sheet that was subjected to magnetic domain refining treatment by an electron beam and falls within our range produces low noise when assembled as an actual transformer and exhibits properties consistent with the designed value. In addition, degradation in iron loss properties is also inhibited.

In contrast, Comparative Examples of steel sample IDs 6, 8 and 10, which were subjected to magnetic domain refining treatment by a laser, and Comparative Examples of steel sample IDs 2, 4, 5, 9, 12, 13 and 14, which were subjected to magnetic domain refining treatment by an electron beam, but are outside our range in terms of their spot diameter of a thermal strain introduced region (A), beam diameter (A'), the relation between these results with irradiation pitch (B), and so on, proved to exhibit inferior iron loss properties.

The invention claimed is:

1. A grain oriented electrical steel sheet comprising a forsterite film formed on a surface thereof, and subjected to magnetic domain refining treatment by electron beam irradiation, wherein tension exerted on the steel sheet by the forsterite film is 2.0 MPa or higher both in a rolling direction and a direction perpendicular to the rolling direction, and wherein a diameter of a thermal strain introduced region (A) and an irradiation pitch (B) in a direction intersecting the rolling direction of the steel sheet on an electron beam irradiation surface satisfy Formula (1):

$$0.5 \leq B/A \leq 5.0 \quad (1), \text{ and}$$

wherein an electron beam diameter in the electron beam irradiation is 0.5 mm or less.

2. A method for manufacturing a grain oriented electrical steel sheet comprising:

subjecting a slab to hot rolling to obtain a sheet;

optionally subjecting the sheet to hot rolled sheet annealing;

subjecting the sheet to cold rolling once, or twice or more with intermediate annealing performed therebetween to be finished to a final sheet thickness;

subjecting the sheet to subsequent decarburization;

applying an annealing separator composed mainly of MgO to a surface of the sheet and subjecting the sheet to final annealing;

subjecting the sheet to subsequent tension coating; and subjecting, after the final annealing or the tension coating, the sheet to magnetic domain refining treatment by electron beam irradiation, wherein (i) the annealing separator has a coating amount of 10.0 $g/m^2$ or more, (ii) coiling tension after application of the annealing separator is controlled at 30 to 150 $N/mm^2$, (iii) an average cooling rate to 700° C. during a cooling step of the final annealing process is controlled to 50° C./h or lower, (iv) an electron beam diameter is controlled to 0.5 mm or less, and an electron beam diameter (A') and an irradiation pitch (B) in a direction intersecting the rolling direction of the steel sheet are controlled within a range expressed by Formula (2):

$$1.0 \leq B/A' \leq 7.0 \quad (2), \text{ and}$$

(v) a diameter of a thermal strain introduced region (A) and an irradiation pitch (B) on a beam irradiation surface is controlled within a range expressed by Formula (1):

$$0.5 \leq B/A \leq 5.0 \quad (1)$$

by adjusting irradiation conditions other than the electron beam diameter and the irradiation pitch.

* * * * *